US008267163B2

(12) United States Patent
Stewart

(10) Patent No.: US 8,267,163 B2
(45) Date of Patent: Sep. 18, 2012

(54) RADIATOR TUBE DIMPLE PATTERN

(75) Inventor: Graeme Stewart, Aylesford (GB)

(73) Assignee: Visteon Global Technologies, Inc., Van Buren Township, MI (US)

( * ) Notice: Subject to any disclaimer, the term of this patent is extended or adjusted under 35 U.S.C. 154(b) by 1220 days.

(21) Appl. No.: 12/049,837

(22) Filed: Mar. 17, 2008

(65) Prior Publication Data

US 2009/0229801 A1 Sep. 17, 2009

(51) Int. Cl.
*F28F 1/42* (2006.01)

(52) U.S. Cl. ..... 165/177; 165/179

(58) Field of Classification Search ..... 165/177, 165/179, DIG. 515, DIG. 516, DIG. 537; 138/38

See application file for complete search history.

(56) References Cited

U.S. PATENT DOCUMENTS

| | | | | |
|---|---|---|---|---|
| 3,525,391 | A | 8/1970 | Day | |
| 4,470,452 | A * | 9/1984 | Rhodes | 165/153 |
| 4,690,211 | A * | 9/1987 | Kuwahara et al. | 165/177 |
| 5,441,105 | A | 8/1995 | Brummett et al. | |
| 5,577,555 | A * | 11/1996 | Hisajima et al. | 165/133 |
| 5,950,716 | A | 9/1999 | Appelquist et al. | |
| 5,996,633 | A | 12/1999 | Kato | |
| 6,267,177 | B1 | 7/2001 | Shinhama et al. | |
| 6,289,982 | B1 | 9/2001 | Naji | |
| 6,336,501 | B1 | 1/2002 | Ishikawa et al. | |
| 6,453,989 | B1 | 9/2002 | Watanabe et al. | |
| 6,513,286 | B2 | 2/2003 | Vierra | |
| 6,550,533 | B2 | 4/2003 | Nakado et al. | |
| 6,595,273 | B2 | 7/2003 | Shimoya | |
| 6,629,561 | B2 | 10/2003 | Halt et al. | |
| 6,644,388 | B1 * | 11/2003 | Kilmer et al. | 165/133 |
| 6,935,418 | B1 | 8/2005 | Valaszkai et al. | |
| 7,011,150 | B2 * | 3/2006 | Komatsubara et al. | 165/177 |
| 2005/0217833 | A1 | 10/2005 | Moser et al. | |
| 2005/0267156 | A1 | 12/2005 | Surleraux et al. | |
| 2006/0016582 | A1 | 1/2006 | Hashimoto et al. | |
| 2006/0196645 | A1 | 9/2006 | Leroy et al. | |

FOREIGN PATENT DOCUMENTS

| | | | |
|---|---|---|---|
| GB | 2090651 | A | 7/1982 |

* cited by examiner

*Primary Examiner* — Teresa Walberg

(74) *Attorney, Agent, or Firm* — Fraser Clemens Martin & Miller LLC; J. Douglas Miller

(57) ABSTRACT

A tube for a heat exchanger is disclosed, the tube including a plurality of protuberances formed on an inner surface of the tube. The protuberances are arranged in a pattern that maintains a substantially constant cross sectional hydraulic area along a length of the tube.

13 Claims, 4 Drawing Sheets

RADIATOR TUBE DIMPLE PATTERN

FIELD OF THE INVENTION

The invention relates generally to a tube for use in a heat exchanger, and more particularly to a tube including a plurality of deformations formed on a surface thereof for use in a heat exchanger.

BACKGROUND OF THE INVENTION

Heat exchangers are used for changing a temperature of various working fluids such as an engine coolant, an engine lubricating oil, an air conditioning refrigerant, and an automatic transmission fluid, for example. The heat exchanger typically includes a plurality of spaced apart fluid conduits or tubes connected between an inlet tank and an outlet tank, and a fin disposed between adjacent conduits. Air is directed across the fins of the heat exchanger by a cooling fan or a motion of a vehicle, for example. As the air flows across the fins, heat in a fluid flowing through the tubes is conducted through the walls of the tubes, into the fins, and into the air.

One of the primary goals in heat exchanger design is to achieve the highest possible thermal efficiency. Thermal efficiency is measured by dividing the amount of heat that is transferred by the heat exchanger under a given set of conditions (amount of air flow, temperature difference between the air and fluid, and the like) by the theoretical maximum possible heat transfer under those conditions. Thus, an increase in the rate of heat transfer under a given set of conditions results in a higher thermal efficiency.

One method typically employed to improve the thermal efficiency of the heat exchanger is to form dimples on the outer surface of the tubes. The dimples form corresponding protrusions on an inner surface of the tubes. The protrusions cause the flow of the fluid within the tubes to be turbulent which is known to increase the heat transfer from the fluid to the tube. However, the dimples typically cause an increase in a pressure drop of the fluid flowing through tubes, in part, because the prior art dimple patterns cause the cross-sectional area of the tubes to vary along the length of the tube. The varying cross-sectional area of the tubes causes a bulk velocity of the fluid to vary along the length of the tubes, which causes the increase in the pressure drop of the fluid. The increase in pressure drop reduces the thermal efficiency of the heat exchanger, and partially offsets the improvement in the thermal efficiency caused by the turbulent flow of the fluid.

The typical dimple pattern interferes also can interfere with the attachment of the radiator fins to the tubes. A brazing process is typically employed to bond one edge of the fins to the outer surface of the tubes. The edge of the fins span the dimples formed in the tube when in alignment therewith. The brazing quality between the fins and the tubes is reduced at the locations where the fins span the dimples, which reduces the heat transfer between the tube and fin, and can reduce the service life of the tube. Additionally, many prior art dimple patterns provide straight line rows of dimples formed on the outer surface of the tubes that, when in alignment with a desired location for a fin, will prevent the brazing of the fin to the tube at the desired location.

It would be desirable to produce a tube for a heat exchanger having a dimple pattern formed thereon, wherein a thermal efficiency of the heat exchanger and a durability of the tube are maximized.

SUMMARY OF THE INVENTION

Compatible and attuned with the present invention, a tube for a heat exchanger having a dimple pattern formed thereon, wherein a thermal efficiency of the heat exchanger and a durability of the tube are maximized, has been invented.

In one embodiment, a tube comprises an outer surface and a spaced apart inner surface coextensive along a longitudinal axis to form a hydraulic area therein; and a plurality of protuberances formed on the inner surface and arranged in a plurality of longitudinal rows, wherein the protuberances in one row are longitudinally offset from the protuberances in another row to maintain a substantially constant hydraulic area of the tube along the longitudinal axis.

In another embodiment, a tube for a heat exchanger comprises a top wall, a bottom wall, and a pair of sidewalls having an outer surface and an inner surface, the walls integrally connected and coextensive along a longitudinal axis to form a hydraulic area therein; and a plurality of protuberances formed on the inner surfaces of the top wall and the bottom wall, the protuberances arranged in a plurality of longitudinal rows, wherein the protuberances in one row are longitudinally offset from the protuberances in another row to maintain a substantially constant hydraulic area along the longitudinal axis.

In another embodiment, a heat exchanger comprises a first header and a spaced apart second header, the first header including a fluid inlet and the second header including a fluid outlet; a plurality of spaced apart tubes attached to the first header at one end and attached to the second header at an opposite end providing fluid communication between the first header and the second header, the tubes having a top wall, a bottom wall, and a pair of sidewalls having an outer surface and an inner surface, the walls integrally connected to form a hydraulic area therein, a plurality of protuberances formed on the inner surfaces of the top wall and the bottom wall, the protuberances arranged in a plurality of longitudinal rows, wherein the protuberances in one row are longitudinally offset from the protuberances in another row to maintain a constant hydraulic area along the longitudinal axis; and a fin disposed between each pair of adjacent tubes.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings in which.

DETAILED DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner.

Figure 1:
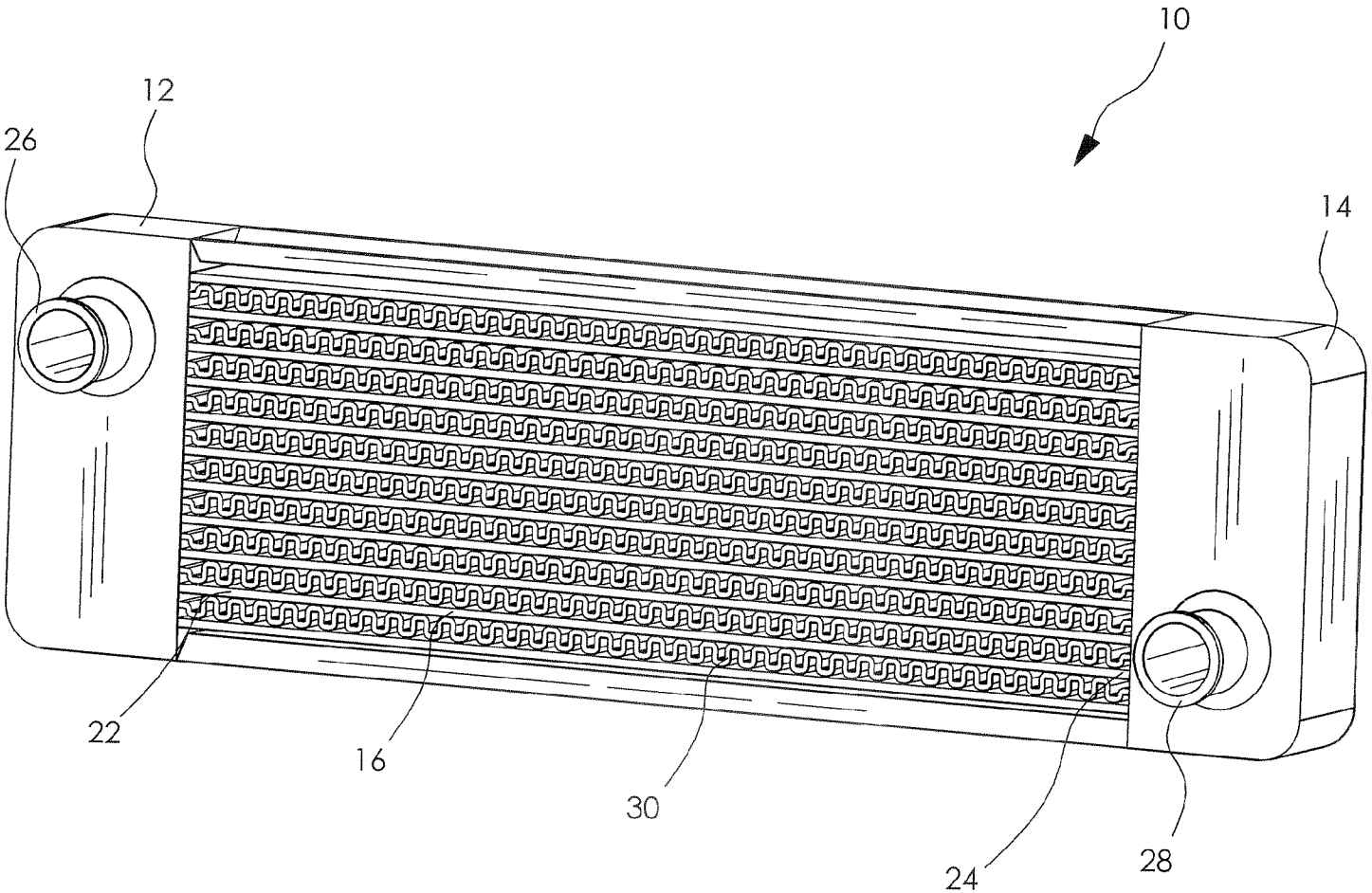
FIG. 1 is a perspective view of a heat exchanger in accordance with an embodiment of the invention.

FIG. 1 shows a heat exchanger assembly 10 according to an embodiment of the invention. The heat exchanger assembly 10 includes a first header 12 and a second header 14 disposed on opposing ends thereof. In the embodiment shown, the heat exchanger assembly 10 is a parallel flow type heat exchanger assembly commonly referred to as a radiator. However, it should be understood that other types of heat exchanger assemblies can be used such as a serpentine-flow type heat exchanger assembly and a U-flow type heat exchanger assembly, for example.

The heat exchanger assembly 10 also includes a plurality of spaced apart substantially parallel tubes 16. As more clearly illustrated in FIG. 2, the tubes 16 include an outer surface 18 and an inner surface 20. The tubes 16 are disposed between and in fluid communication with the first header 12 and the second header 14. Each of the tubes 16 is connected at a first end 22 to the first header 12, and at a second end 24 to the second header 14. In the embodiment shown, the headers 12, 14 and the tubes 16 are formed from aluminum. However, any suitable material can be used, as desired.

The first header 12 includes an inlet fitting 26, and a plurality of tube openings (not shown) formed therein for receiving the first ends 22 of the tubes 16. The inlet fitting 26 is adapted to provide fluid communication between a source of fluid or coolant (not shown) and the first header 12. The tube openings provide fluid communication between the first header 12 and the tubes 16.

The second header 14 includes an outlet fitting 28, and a plurality of tube openings (not shown) formed therein for receiving the second ends 24 of the tubes 16. The outlet fitting 28 provides an exit for the fluid flowing through the heat exchanger assembly 10. The tube openings provide fluid communication between the tubes 16 and the second header 14. Favorable results have been obtained employing a brazing process to attach the respective ends 22, 24 of the tubes 16 to the headers 12, 14. It should be understood that other suitable means now known or later developed may be used to attach the tubes 16 to the headers 12, 14.

A fin 30 is disposed between each pair of adjacent tubes 16. The fins 30 are attached to the facing outer surfaces 18 of the adjacent tubes 16. The fins 30 are adapted to allow a flow of air to pass therebetween, and between the tubes 16 to facilitate a transfer of heat energy from the fins 30 and the tubes 16 to the air. Favorable results have been obtained employing a brazing process to attach the fins 30 to the tubes 16. It should be understood that other suitable means now known or later developed may be used to attach the fins 30 to the tubes 16. The fins 30 typically have a corrugated shape with a series of convolutes that extend between adjacent tubes 16, as is known in the art.

Figure 2:
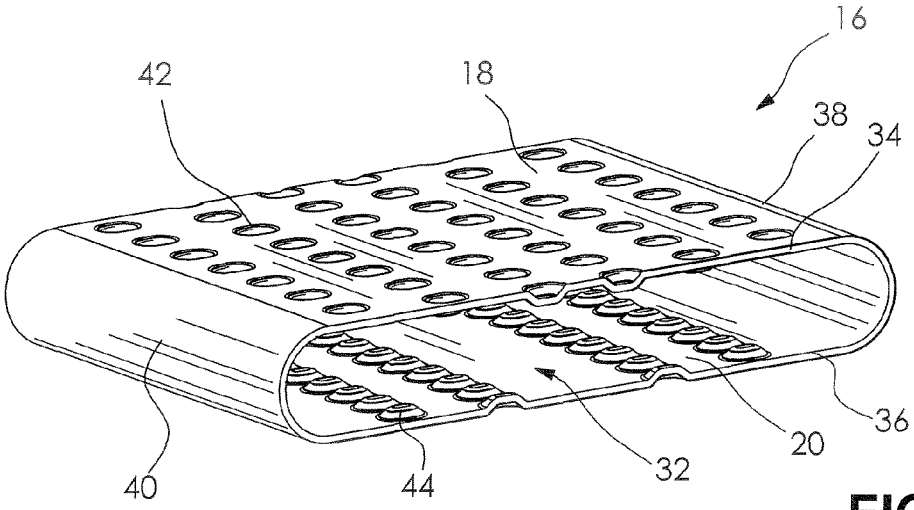
FIG. 2 is a perspective view of a portion of a tube disposed in the heat exchanger illustrated in FIG. 1 showing a pattern of dimples formed in the tube.
Figure 3:
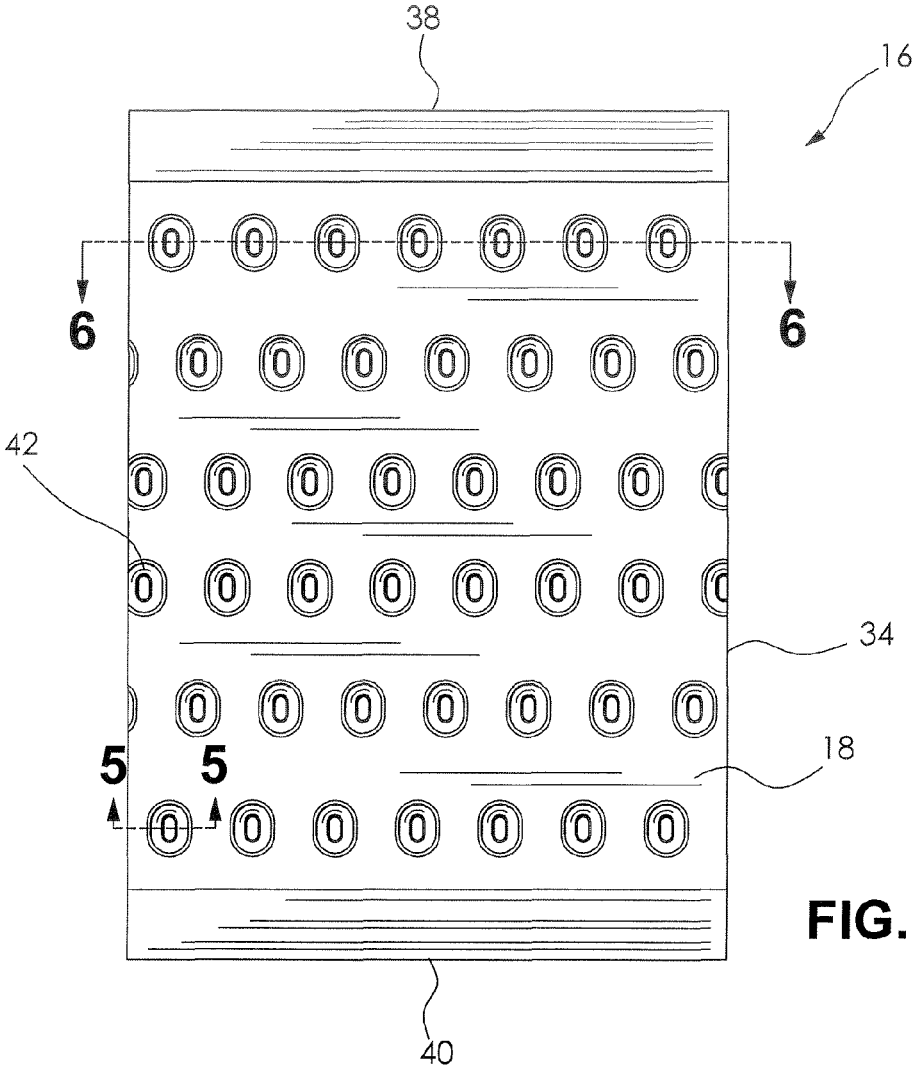
FIG. 3 is a top plan view of the tube illustrated in FIG. 2.
Figure 4:
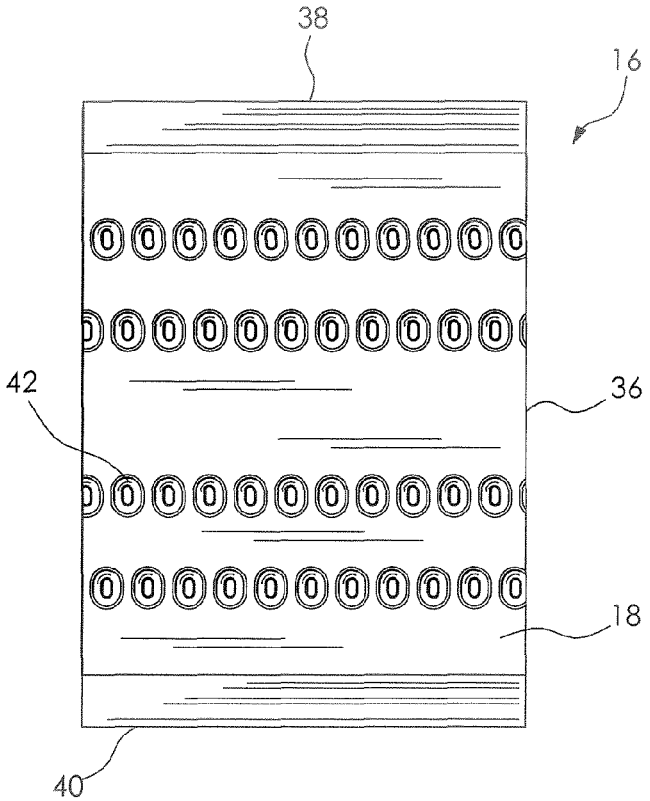
FIG. 4 is a bottom plan view of the tube illustrated in FIG. 2.

As more clearly shown in FIGS. 2 through 4, the tubes 16 are generally rectangular shaped in cross-section and form a flow path or hydraulic area 32 therein. The hydraulic area 32 extends longitudinally from the first end 22 to the second end 24 of the tubes 16. It should be understood that the tubes 16 can be formed to have a plurality of hydraulic areas therein divided from one another by one or more walls or tube dividers, for example. It should be understood that the tubes 16 may have any cross-sectional shape as desired. The tubes 16 include a substantially planar top wall 34 and a substantially planar bottom wall 36. The tubes 16 also include a first side wall 38 and a second side wall 40 integrally formed with the top wall 34 and the bottom wall 36 to form the generally rectangular shaped cross-section of the tubes 16. In the illustrated embodiment, the side walls 38, 40 are generally arcuate in shape. It should be understood that the side walls 38, 40 may have other shapes.

The tubes 16 include a plurality of deformations or recesses 42, typically referred to as dimples, formed in the outer surface 18 of the tube 16. The deformations 42 form corresponding protuberances 44 on the inner surface 20 of the tube 16 that extend into the hydraulic area 32. The protuberances 44 cause a turbulent flow of the fluid flowing within the hydraulic area 32. In the embodiment shown, the deformations 42 are formed on the top wall 34 and the bottom wall 36 of the tubes 16. However, it should be understood that the deformations 38 can be formed on only one of the top wall 34 and the bottom wall 36, and may also be formed on the side walls 38, 40 of the tubes 16. In the embodiment shown, the deformations 42 and the protuberances 54 have a generally oblong circle shape when viewed from above. However, it should be understood that the deformations 42 the protuberances 54 can have a circular shape, a square shape, a rectangular shape, or other shape. As used herein, an oblong circle shape is substantially oval.

Figure 5:
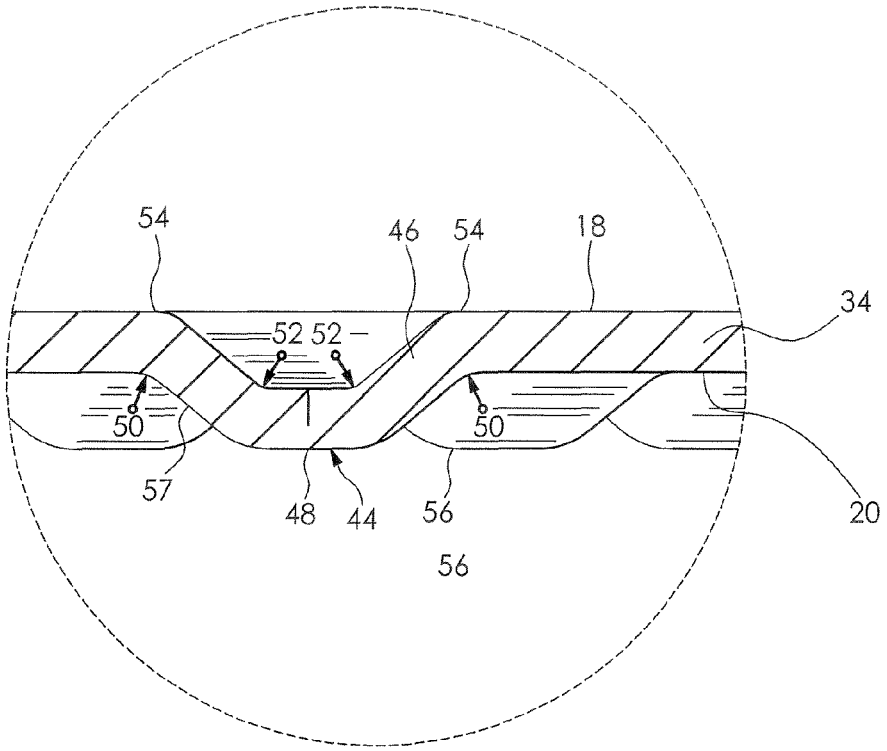
FIG. 5 is an enlarged fragmentary cross-sectional view of the dimples illustrated in FIGS. 2 - 4 taken along line 5-5 in FIG. 3.

FIG. 5 is a cross sectional view of the tube 16 showing the deformations 42 and protuberances 44 illustrated in FIGS. 2 through 4. It should be understood that the structure of the deformation 42 is identical to the protuberance 44, as the two are complimentary sides of the same structural component. However, for the purpose of clarity, the structural component will be described in terms of the protuberance 44. The protuberances 44 include a plurality of radii and flat portions integrally connected to form a peripheral side 46 and a substantially planar web 48 disposed thereon. The peripheral side 46 is formed at a selected angle in respect of the top wall 34. Favorable results have been obtained employing an angle for the peripheral side between about forty-three degrees and forty-seven degrees. However, it should be understood that other angles can be selected. The peripheral side 46 includes at least a first radius 50 transitioning from the top wall 34 at an edge 54 and at least one subsequent radius 52. A planar section 51 is disposed between the first radius 50 and the second radius 52. It should be understood that the peripheral side 46 can be defined by more radii if desired, and can include additional planar sections or no planar sections if desired.

As shown in FIGS. 2 through 4, the protuberances 44 are formed on the top wall 34 and the bottom wall 36 in a plurality of rows extending the length of the tubes 16. In the illustrated embodiment, six (6) rows of protuberances 44 are formed in the top wall 34 and four (4) rows of protuberances 44 are formed in the bottom wall 36. It should be understood that fewer or additional rows of protuberances 44 may be formed in the top wall 34 and the bottom wall 36 as desired.

Figure 6:
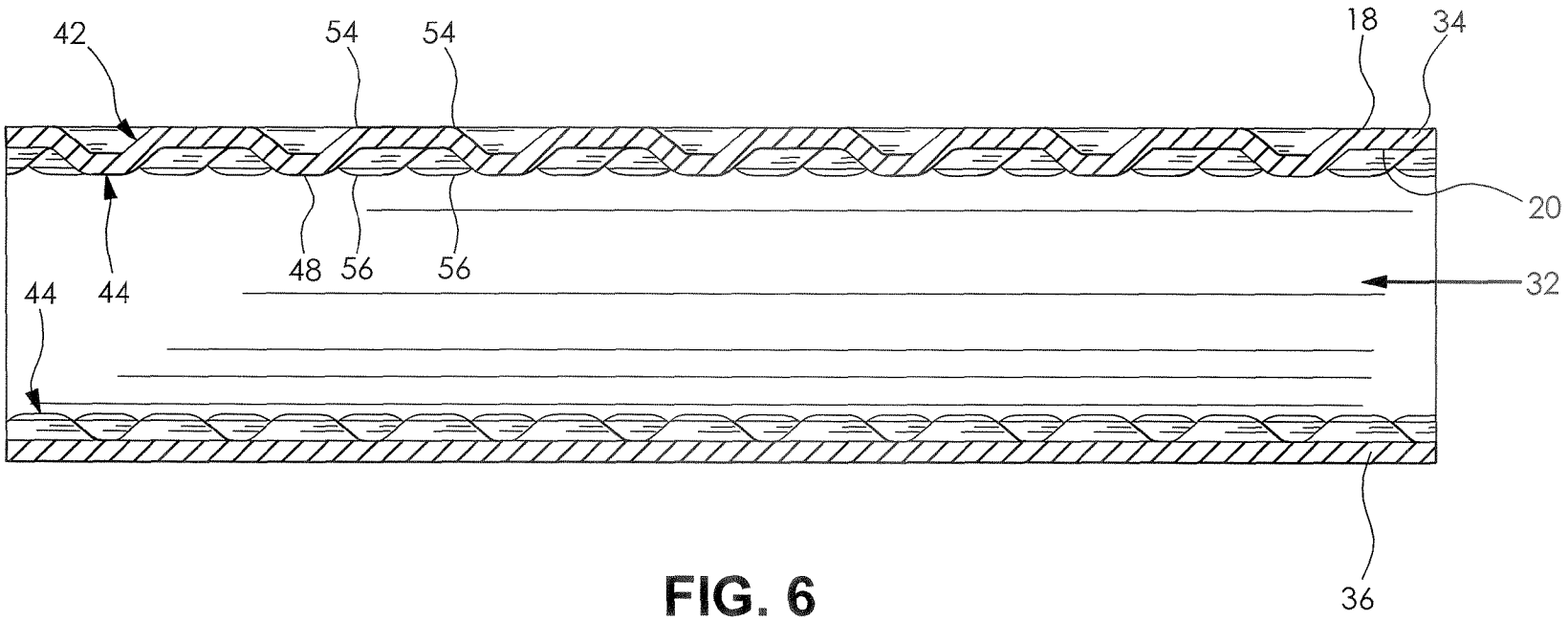
FIG. 6 is an enlarged cross-sectional view of the tube taken along line 6-6 in FIG. 3.

Adjacent rows of the protuberances 44 are offset in a longitudinal direction of the tube 16. Thus, the protuberances 44 are not in alignment across a width of the tubes 16. The misalignment of the protuberances 44 across the width of the tube 16 positions the peripheral edge 54 of one protuberance 44 in alignment across the width of the tubes 16 with the peripheral edge 56 of the web 48 in another protuberances 44. As more clearly illustrated in FIGS. 5 and 6, the position of the protuberances 44 creates a pattern wherein in the longitudinal direction of the tube 16 as one protuberances 44 in one row is beginning another protuberances 44 in another row is ending, i.e. the position of the peripheral side 46 of one protuberance 44 overlaps the position of the peripheral side 46 of another protuberances 44. The pattern causes the cross-sectional hydraulic area 32 of the tube 16 to remain constant along the length of the tube 16.

Favorable results have been obtained by forming the tube 16 from an elongate planar sheet of metal having opposing lateral edges and end edges. The protuberances 44 are formed in the planar sheet of metal in the desired pattern employing a stamping operation. The lateral edges of the planar sheet are then caused to come together by a folding, bending or shaping of the planar sheet into a desired shape and joining the opposing lateral edges in an abutting or overlapped configuration to form the elongate tube 16. It should be understood that the lateral edges can be joined employing a brazing process or other suitable means now known or later developed. Additionally, it should be understood that at a least one of the lateral edges can be formed to extend inwardly into the hydraulic area 32 of the tube 16 with the opposing lateral edge joined adjacent thereto. The at least one lateral edge forming a wall or tube divider defining two hydraulic areas within the tube 16. It should be understood that the tube 16 can be formed employing other suitable methods now known or later developed.

In use, a first fluid (not shown) is caused to flow through the inlet fitting 26 into the first header 12. The first fluid can be any conventional fluid such as a coolant fluid, automatic transmission fluid, power steering fluid, or engine oil, for example. The first fluid then flows into the hydraulic area 32 of the tubes 16 through the corresponding tube openings formed in the first header 12. The first fluid contains thermal energy which is transferred to the inner surfaces 20 of the tubes 16 as the first fluid flows therethrough. The thermal energy is transferred from the inner surfaces 20 of the tubes 16 to the outer surfaces 18 of the tubes and the fins 30 attached thereto.

A second fluid (not shown) is caused to flow past the outer surfaces 18 of the tubes 16 and the fins 30. The second fluid can be any conventional fluid such as ambient air, for example. The second fluid contacts the outer surfaces 18 of the tubes 16 and the fins 30. The thermal energy transferred to the tubes 16 and the fins 30 from the first fluid is transferred to the second fluid as the second fluid contacts the outer surfaces 18 of the tubes 16 and the fins 30. The transfer of the thermal energy from the first fluid to the second fluid as described herein reduces the thermal energy or a temperature of the first fluid. The first fluid then flows into the second header 14 and out of the second header 14 through the outlet fitting 28. Upon exiting the second header 14, the first fluid has reduced thermal energy as compared to its thermal energy when entering the first header 12. The reduced thermal energy results from the transfer of the thermal energy from the first fluid to the second fluid.

The protuberances 44 formed in the tubes 16 provide additional surface area for the first fluid to contact within the hydraulic area 32 of the tubes 16. Further, a fluid boundary layer is caused to detach from the inner surface 20 of the tube 16 at the protuberances 44 formed as the first fluid changes direction to flow around the protuberances 44. The fluid boundary layer then reestablishes itself and continues to grow downstream of the protuberances 44. The fluid boundary layer is caused to detach repeatedly in a periodic pattern. The periodic detachment of the fluid boundary layer maximizes the transfer of thermal energy from the first fluid to the inner surface 20 of the tubes 16 by disrupting a laminar flow pattern of the first fluid.

A unique pattern of the protuberances 44 formed in the tubes 16 provides a substantially constant cross-sectional hydraulic area 32 of the tube 16 along the length of the tube 16. A substantially constant cross-sectional hydraulic area 32 of the tube 16 causes a bulk velocity of the first fluid to remain substantially constant along the length of the tube 16. A substantially constant bulk velocity of the first fluid minimizes a pressure drop of the first fluid as it flows from the first header 12 to the second header 14. A minimized pressure drop of the first fluid maximizes the transfer of thermal energy from the first fluid to the inner surface 20 of the tubes 16. A unique pattern of the protuberances 44 formed in the tubes 16 minimizes the pressure drop and maintains a turbulent flow of the first fluid, which maximizes the thermal efficiency of the heat exchanger 10.

Further, the unique pattern of the protuberances 44 formed in the tubes 16 facilitates the attachment of the fins 30 to the outer surface 18 of the tube 16. Because the deformations 42 corresponding with the protuberances 44 are not in alignment across the width of the tubes 16, the fins 30 have multiple attachment points to the outer surface 18 of the tubes 16 away from the location of a deformation 42. This arrangement maximizes the quality of the attachment of the fin 30 to the outer surface 18 of the tube 16 which increases the heat transfer between the tube 16 and the fin 30, and maximizes the service life of the tube 16.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A tube comprising:

an outer surface and a spaced apart inner surface coextensive along a longitudinal axis to form a hydraulic area therein; and a plurality of protuberances formed on the inner surface and arranged in a plurality of longitudinal rows, the protuberances including a first radius and a second radius with a planar section disposed therebetween to form a peripheral side of the protuberance, wherein the first radius extends from a peripheral edge of the protuberance, and the second radius terminates at an edge of a substantially planar web integrally formed therewith, wherein the protuberances in one row are longitudinally offset from the protuberances in another row to maintain a substantially constant hydraulic area of the tube along the longitudinal axis, wherein the longitudinal offset of the rows of protuberances positions the peripheral edge of the protuberances in one row in substantial alignment across a width of the tube with the edge of the substantially planar web of the protuberances in another row.

2. The tube according to claim 1, wherein the tube has a top wall, a bottom wall, and a pair of sidewalls integrally connected to form a generally rectangular shaped cross-section of the tube.

3. The tube according to claim 2, wherein the plurality of protuberances are formed on at least one of the top wall and the bottom wall.

4. The tube according to claim 1, wherein the protuberances are formed by a deformation formed in the outer surface of the tube.

5. The tube according to claim 1, wherein the protuberances have a general shape of one of a circle, rectangle, square, oval, and oblong circle when viewed from above.

6. The tube according to claim 1, wherein the tube is formed from a metal.

7. The tube according to claim 1, wherein the tube is formed from aluminum.

8. A tube for a heat exchanger comprising:

a top wall, a bottom wall, and a pair of sidewalls having an outer surface and an inner surface, the walls integrally connected and coextensive along a longitudinal axis to form a hydraulic area therein; and a plurality of protuberances formed on the inner surfaces of the top wall and the bottom wall, the protuberances arranged in a plurality of longitudinal rows and including a first radius and a second radius with a planar section disposed therebetween to form a peripheral side of the protuberance, wherein the first radius extends from a peripheral edge of the protuberance, and the second radius terminates at an edge of a substantially planar web integrally formed therewith, wherein the protuberances in one row are longitudinally offset from the protuberances in another row to maintain a substantially constant hydraulic area along the longitudinal axis, wherein the longitudinal offset of the rows of protuberances positions the peripheral edge of the protuberances in one row in substantial alignment across a width of the tube with the edge of the substantially planar web of the protuberances in another row.

9. The tube for a heat exchanger according to claim 8, wherein the protuberance has a general shape of one of a circle, rectangle, square, oval, and oblong circle when viewed from above.

10. The tube for a heat exchanger according to claim 8, wherein the planar section of the peripheral side has an angle in respect of the inner surface of at least one of the top wall and the bottom wall between about forty-three and forty-seven degrees.

11. The tube for a heat exchanger according to claim 8, wherein the tube is formed from aluminum.

12. A heat exchanger comprising:

a first header and a spaced apart second header, the first header including a fluid inlet and the second header including a fluid outlet;

a plurality of spaced apart tubes attached to the first header at one end and attached to the second header at an opposite end providing fluid communication between the first header and the second header, the tubes having a top wall, a bottom wall, and a pair of sidewalls having an outer surface and an inner surface, the walls integrally connected to form a hydraulic area therein, a plurality of protuberances formed on the inner surfaces of the top wall and the bottom wall, the protuberances arranged in a plurality of longitudinal rows and including a first radius and a second radius with a planar section disposed therebetween to form a peripheral side thereof, the first radius extending from a peripheral edge of the protuberance and the second radius terminating at an edge of a substantially planar web integrally formed therewith, wherein the protuberances in one row are longitudinally offset from the protuberances in another row to maintain a constant hydraulic area along the longitudinal axis, and wherein the longitudinal offset of the rows of protuberances positions the peripheral edge of the protuberances in one row in substantial alignment across a width of the tube with the edge of the substantially planar web of the protuberances in another row; and a fin disposed between each pair of adjacent tubes.

13. The heat exchanger according to claim 12, wherein the heat exchanger assembly is one of a parallel flow type heat exchanger assembly, a serpentine-flow type heat exchanger assembly, and a U-flow type heat exchanger assembly.

* * * * *